US010214322B2

(12) United States Patent
Tan

(10) Patent No.: US 10,214,322 B2
(45) Date of Patent: Feb. 26, 2019

(54) CHILD RESISTANT PLASTIC BAG ASSEMBLY

(71) Applicant: Pan Pacific Plastics Mfg., Inc., Hayward, CA (US)

(72) Inventor: Hin Siang Michael Tan, Danville, CA (US)

(73) Assignee: PAN PACIFIC PLASTICS MFG., INC., Hayward, CA (US)

( * ) Notice: Subject to any disclaimer, the term of this patent is extended or adjusted under 35 U.S.C. 154(b) by 0 days.

(21) Appl. No.: 15/432,730

(22) Filed: Feb. 14, 2017

(65) Prior Publication Data

US 2018/0037372 A1 Feb. 8, 2018

Related U.S. Application Data

(60) Provisional application No. 62/295,968, filed on Feb. 16, 2016.

(51) Int. Cl.
*A44B 19/30* (2006.01)
*B65D 33/25* (2006.01)
*A44B 19/16* (2006.01)

(52) U.S. Cl.
CPC ..... *B65D 33/2591* (2013.01); *A44B 19/16* (2013.01); *A44B 19/301* (2013.01); *B65D 2215/04* (2013.01)

(58) Field of Classification Search
CPC ..... A44B 19/30; A44B 19/301
USPC ..... 386/63–65, 61.5, 92, 68, 69; 24/387, 24/388, 436; 190/120
See application file for complete search history.

(56) References Cited

U.S. PATENT DOCUMENTS 2,421,067 A * 5/1947 Howe ..... D06F 95/006 229/78.2
3,852,851 A * 12/1974 Higuchi ..... A44B 19/301 24/387
5,681,115 A 10/1997 Diederich et al.
5,711,609 A 1/1998 Simonsen
5,924,173 A * 7/1999 Dobreski ..... B65D 33/2591 24/387
6,185,791 B1 2/2001 Khokhar
6,361,213 B2 * 3/2002 Randall ..... B65D 33/2591 383/64

(Continued)

*Primary Examiner* — Jes F Pascua
*Assistant Examiner* — Nina K Attel
(74) *Attorney, Agent, or Firm* — Beyer Law Group LLP

(57) ABSTRACT

A child resistant, zippered plastic bag assembly having a first side panel and a second side panel each having respective upper portions forming a mouth. The bag assembly includes a zippered closure coupled to the respective upper portions of the first and second side panels for interlocking the mouth between an opened condition and a closed condition. A slider having a base operably mounted to, and cooperating, with the zipper closure for movement between a first position, orienting the mouth in the closed condition, and a second position, orienting the mouth in the opened condition. The slider includes a first wing extending outwardly from the base, adjacent the upper portion of the first side panel, and a second wing also extending outwardly from the base, adjacent the upper portion of the second side panel. A lock is operable between the first wing and second wing, and configured to cooperate with the first side panel and the second side panel in a locked state to lock the slider in the first position.

9 Claims, 8 Drawing Sheets

(56) References Cited

U.S. PATENT DOCUMENTS

| | | | | |
|---|---|---|---|---|
| 8,276,244 | B2 | 10/2012 | Vermeer et al. | |
| 2004/0062457 | A1 * | 4/2004 | Plourde ..... | B65D 33/2591 383/64 |
| 2006/0168779 | A1 | 8/2006 | Chaturvedi | |
| 2014/0161374 | A1 | 6/2014 | Septien Rojas et al. | |
| 2014/0270585 | A1 | 9/2014 | Heckman | |
| 2014/0270586 | A1 | 9/2014 | Petkovsek | |
| 2014/0270596 | A1 | 9/2014 | Dowler et al. | |
| 2014/0298757 | A1 | 10/2014 | Chapek | |
| 2014/0311101 | A1 | 10/2014 | Petkovsek et al. | |
| 2014/0311102 | A1 | 10/2014 | Petkovsek et al. | |

* cited by examiner

CHILD RESISTANT PLASTIC BAG ASSEMBLY

RELATED APPLICATIONS

This application claims priority to provisional application No. 62/295,968 filed Feb. 16, 2016 which is entitled "CHILD RESISTANT PLASTIC BAG ASSEMBLY", naming Tan as the inventor, and which is incorporated by reference in its entirety.

FIELD OF THE INVENTION

The present invention relates to reusable plastic bags, and more particularly, relates to reusable child resistant plastic bags with a lock device.

BACKGROUND OF THE INVENTION

Typical plastic bags with slider or zip lock style closures are generally manufactured as airtight as far as solids and powders are concerned, and are generally leak proof as well. These style plastic bags, however, offer little resistance to opening by young children. With the adoption of legalized marijuana use by many states, prescription drugs, medicines, important documents and a variety of other products that need to be kept out of the reach of young children, there is a need to provide slider or zip lock style plastic bags that are also child proof.

SUMMARY OF THE INVENTION

The present invention provides a child resistant, zippered plastic bag assembly having an openable and recloseable mouth. The bag assembly includes a first side panel and a second side panel each having respective upper portions forming the mouth. The panels also include opposing bottom sides, and respective first and second opposing sides being joined together so as to define a storage volume. The bag assembly further including a zippered closure device coupled to the respective upper portions of the first and second side panels for interlocking the mouth between a closed condition and an opened condition. A slider device is included having a base member operably mounted to, and cooperating, with the zipper closure device for movement therealong between a first position, orienting the mouth in the closed condition, and a second position, orienting the mouth in the opened condition. The slider device includes a first wing extending outwardly from the base member, adjacent the respective upper portion of the first side panel, and a second wing also extending outwardly from the base member, adjacent the respective upper portion of the second side panel. In accordance with the present invention, the bag assembly includes a lock device operable between the first wing and second wing, and configured to cooperate with the first side panel and the second side panel in a locked state to lock the slider device in the first position.

In one specific embodiment, the lock device includes a locking post extending away from an interior surface of the first wing, toward the second wing. The locking post is configured to be manually positioned through aligned retaining apertures in the first and second side panels, when the slider device is oriented in the first position, and into engagement with an aligned locking port in the second wing. This reorients the first and second wings from an unlocked state to a locked state. Locking the slider device in the first position.

In another specific embodiment, the first and second wings extend distally from the base member in a direction away from the second position of the slider device.

Another configuration provides the first and second wings angled slightly downwardly such that the locking post and the aligned retaining apertures are oriented below the zippered closure device.

Still another specific embodiment provides the first and second wings flexibly mounted to the base member at respective neck portions that are narrower than a vertical width thereof.

In one specific configuration, the locking post and the locking port are configured to removably lock to one another in the locked state.

In yet another embodiment, the locking post includes a head portion at a distal end thereof the locking post has a diameter and circumference slightly larger than that of the locking post, and is configured for press-fit through the locking port.

In still another configuration, the locking port includes one or more retaining tabs.

In one specific embodiment, the second wing is longer than that of the first wing along respective longitudinal axis thereof. A longitudinal length of the second wing is such that when in the locked state, a distal end of the second wing terminate proximate to the first side of the first and second side panels.

Another embodiment provides align retaining apertures which are disposed in reinforced respective upper portions of the closure device.

In another aspect of the present invention, a slider device is provided for a plastic bag zipper closure having a male track mounted to a first support sheet and a female track mounted to a second support sheet. The male track and the female track have complementary profiles for interlocking and unlocking the tracks. The slider device of the present invention includes a base member having an upper portion, a first slider wall and an opposed second slider wall. Both slider walls extend downwardly from the base upper portion. The base member is adapted to move along top edges of the tracks with the first and second slider walls straddling the tracks between a first position, fully interlocking the tracks, and a second position, fully unlocking the tracks. The slider device further includes a first wing extending outwardly from the first slider wall, generally adjacent the first support sheet, and a second wing extending outwardly from the second slider wall, generally adjacent the second support sheet. The first wing further includes a locking post extending away from an interior surface thereof, toward the second wing. The locking post is configured to be manually positioned through aligned retaining apertures in the first and second support sheets, when the slider device is oriented in the first position, and into engagement with an aligned locking port in the second wing. In this configuration, the first and second wings are reoriented from an unlocked state to a locked state, locking the slider device in the first position.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawings, in which:

DETAILED DESCRIPTION OF THE INVENTION

Figure 1:
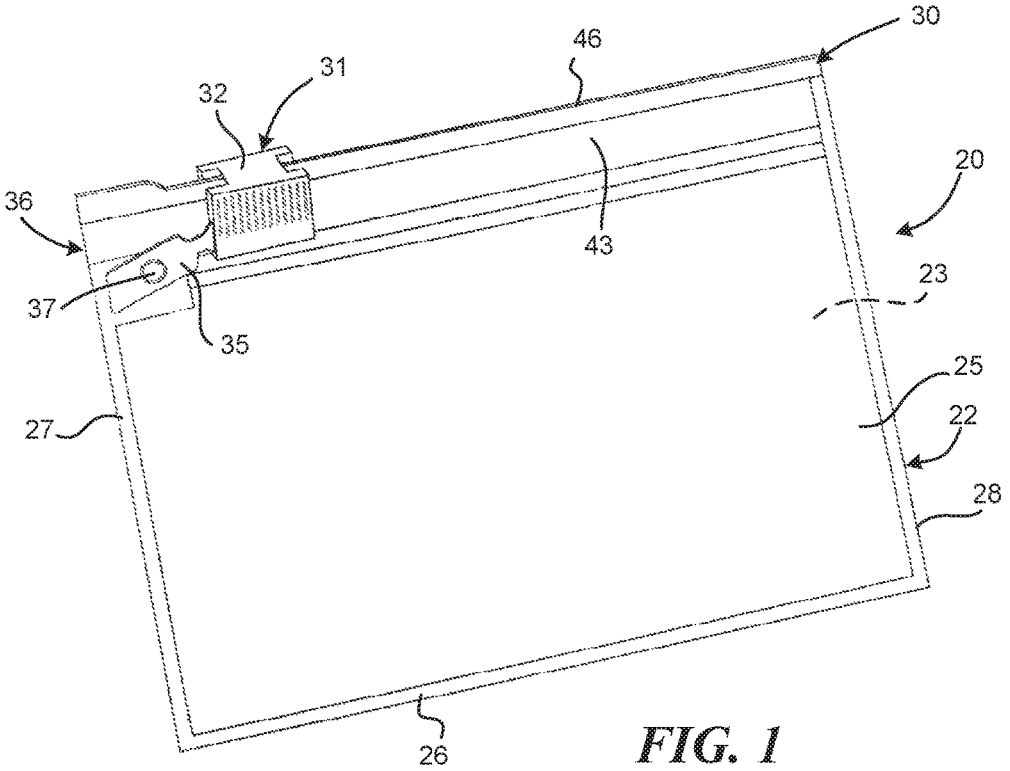
FIG. 1 is a top perspective view of a child resistant plastic bag assembly constructed in accordance with the present invention with a zippered closure device in a closed position, a slider device in a first position, and a lock device thereof in a locked state.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
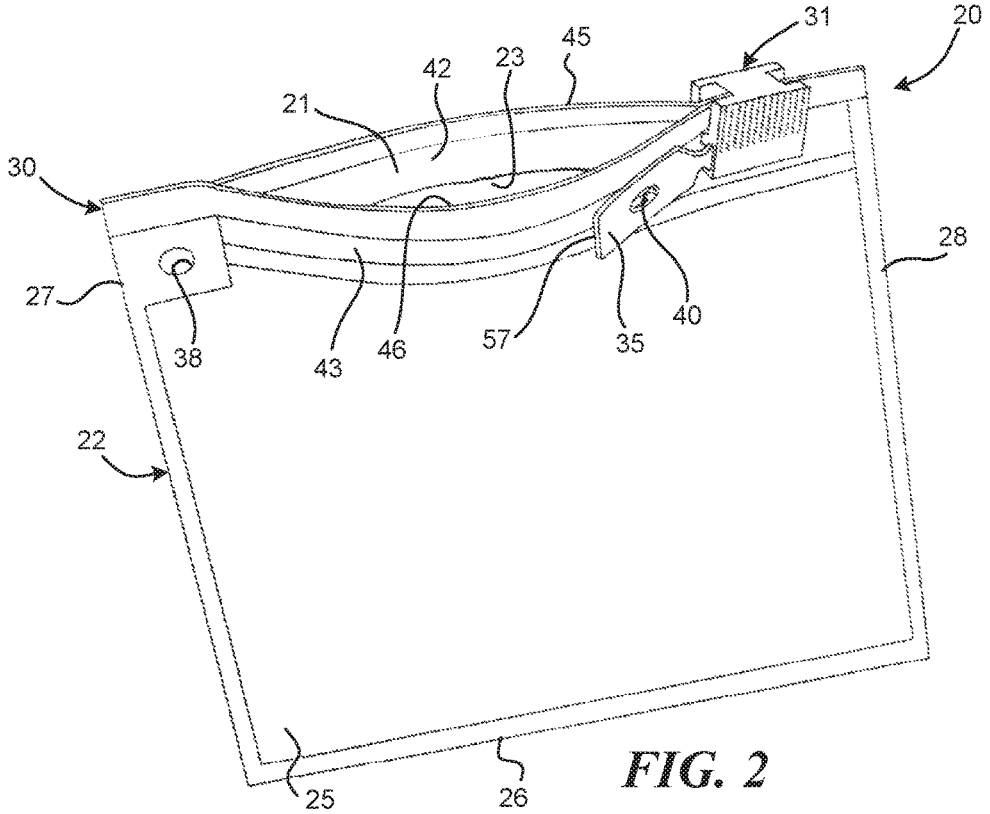
FIG. 2 is a top perspective view of the child resistant plastic bag assembly of FIG. 1, showing the zippered closure device in an opened position.
Figure 3:
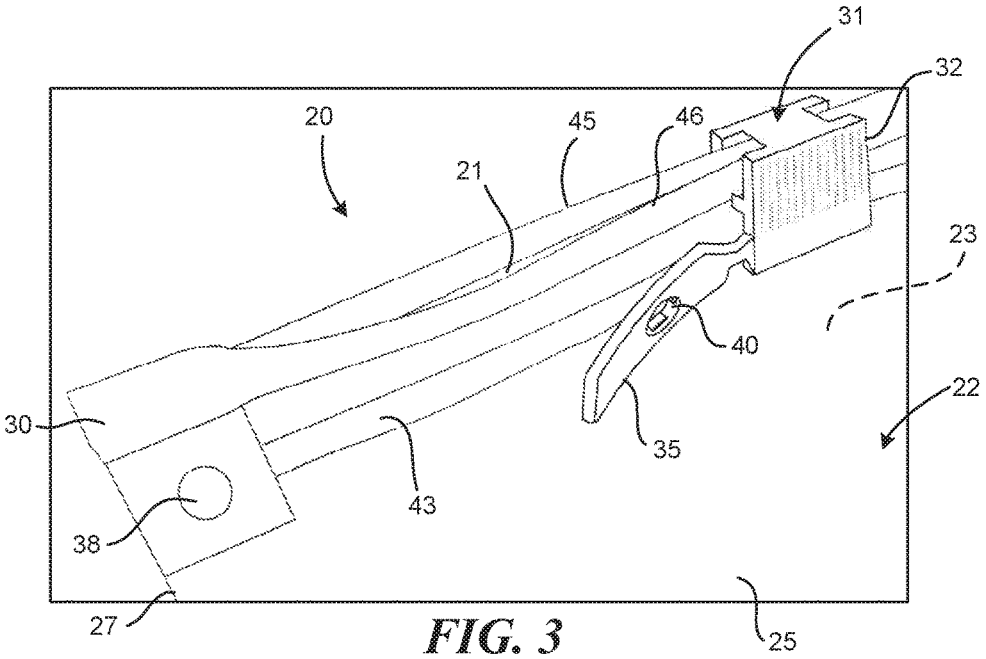
FIG. 3 is a fragmentary, top perspective view of the child resistant plastic bag assembly of FIG. 1, showing a slider device moved toward a second position, and the lock device thereof in an unlocked state.
Figure 4:
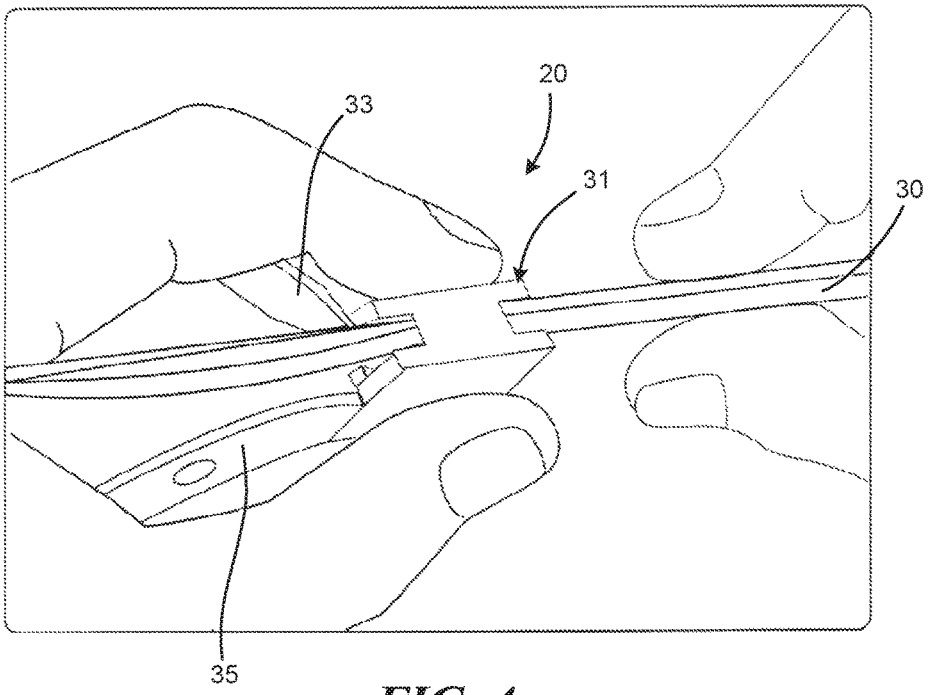
FIG. 4 is a fragmentary, top perspective view of the child resistant plastic bag assembly of FIG. 1, showing manual movement of the slider device toward the first position.
Figure 5:
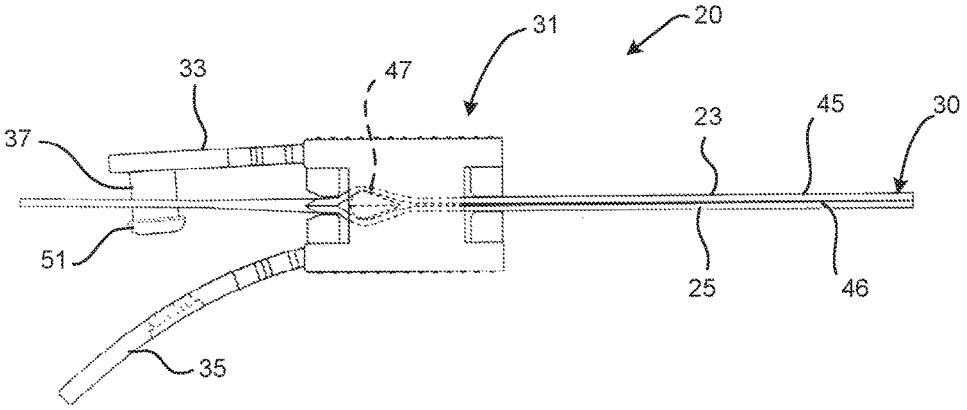
FIG. 5 is a fragmentary, top plan view of the child resistant plastic bag assembly of FIG. 1, showing commencement of operation of the lock device toward the locked state.
Figure 7:
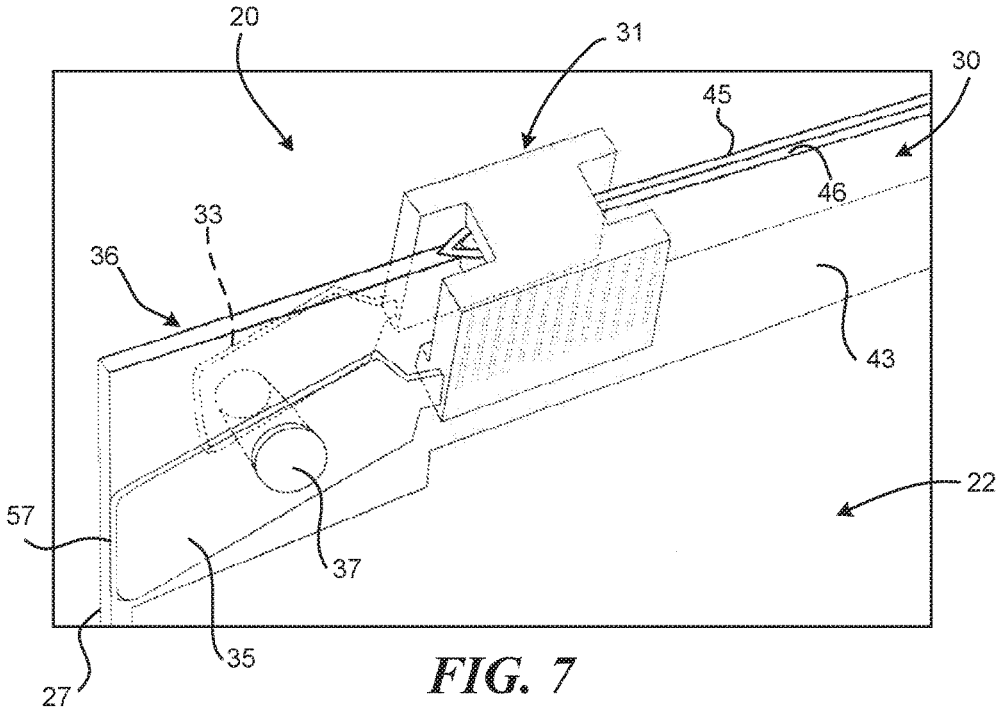
FIG. 7 is a fragmentary, top perspective view of the child resistant plastic bag assembly of FIG. 1, showing the slider device toward the first position and the lock device in the locked state.
Figure 8:
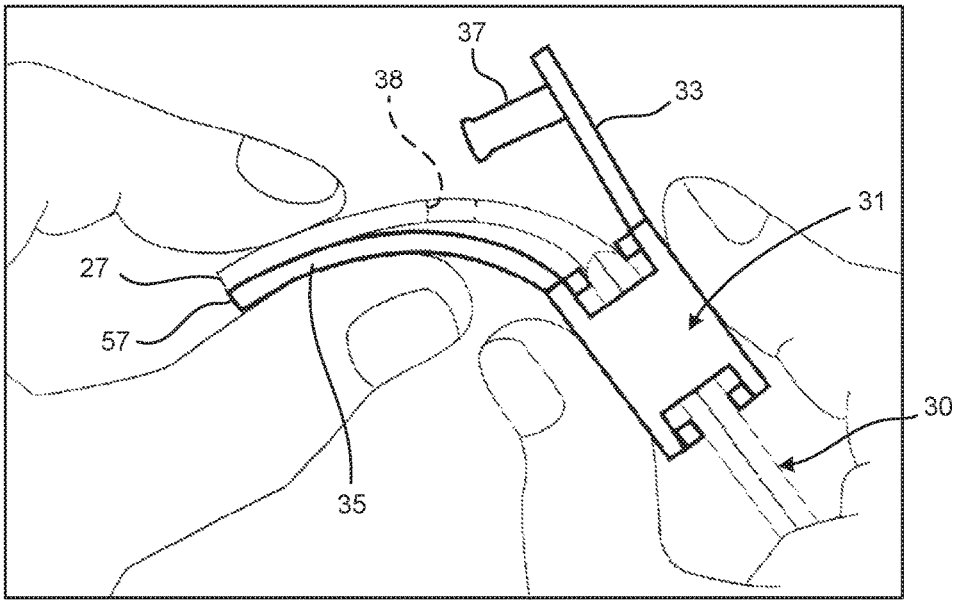
FIG. 8 is a fragmentary, top plan view of the child resistant plastic bag assembly of FIG. 1, showing manual operation of the lock device thereof to the unlocked state.
Figure 9:
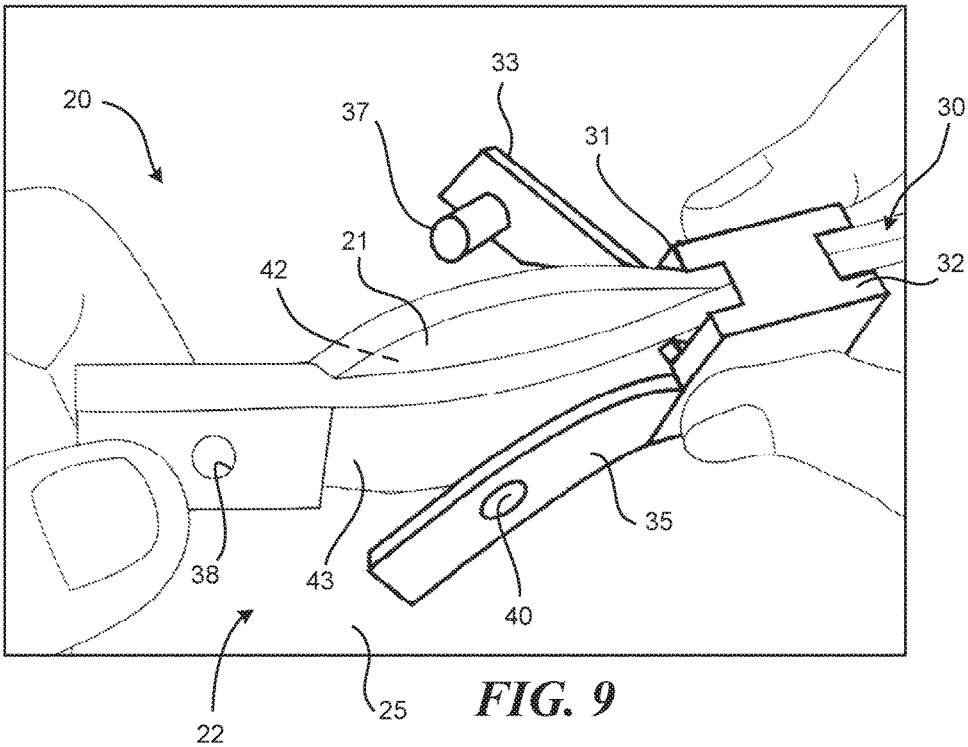
FIG. 9 is a fragmentary, top perspective view of the child resistant plastic bag assembly of FIG. 1, showing manual movement of the slider device moved toward a second position.

Turning now to FIGS. 1-9 a child resistant, zippered plastic bag assembly 20 is provided having an openable and recloseable mouth 21. The bag assembly includes a poly bag 22 with a first side panel 23 and an opposed second side panel 25 each having respective upper portions forming the mouth 21, opposing joined bottom sides 26, and first and second opposing, joined side edges 27, 28 that collectively define a storage volume between the panels. The bag assembly 20 further includes a zippered closure device 30 coupled to the respective upper portions of the first and second side panels 23, 25 for interlocking the mouth between a closed condition (FIGS. 1 and 5-8) and an opened condition (FIGS. 2 and 9). A slider device 31 is further included having a base member 32 operably mounted to, and cooperating, with the zipper closure device 30 for movement therealong between a first position (FIGS. 1 and 5-8), orienting the mouth in the closed condition, and a second position (FIG. 2), orienting the mouth in the opened condition. The slider device 31 includes a first wing 33 extending outwardly from the base member 32, adjacent the respective upper portion of the first side panel 23, and a second wing 35 also extending outwardly from the base member 32, adjacent the respective upper portion of the second side panel 25. In accordance with the present invention, a lock device 36 is operable between the first wing 33 and second wing 35, and is configured to cooperate with the first side panel and the second side panel in a locked state FIGS. 1, 6 and 7) to lock the slider device in the first position.

Accordingly, a typical plastic bag assembly with a zippered-style closure is provided that is capable of releasably locking the slider device 31 relative to the zippered closure, affixing the slider device to the poly bag (in the first position (FIGS. 1, 6 and 7), and retaining the zippered closure device in the closed condition. An effective child resistant plastic bag is created that can be unlocked and opened by an adult.

In particular, the lock device 36 includes a locking post 37 extending away from an interior surface of the first wing 33, toward the second wing 35 (FIGS. 5 and 10-13). The locking post 37 is configured to be manually positioned through a common aligned retaining aperture 38 through both the first and second side panels 23, 25, when the slider device 31 is oriented in the first position. Moreover, the locking post 37 can be moved into engagement with an aligned locking port 40 in the second wing 35, reorienting the first and second wings from an unlocked state (FIGS. 2-5 and 8-13) to a locked state (FIGS. 1, 6 and 7) to lock the slider device 31 in the first position, and thus the zipper closure device 30 in the closed condition (FIGS. 1 and 5-8).

Referring now to FIGS. 1 and 2, the bag assembly 20 preferably includes a conventional collapsible poly bag 22 having essentially the first side panel 23 and the opposed second side panel 25 disposed in an adjacent, side-by-side relationship that can be heat sealed peripherally all around, or at selected common edges thereof. The section at the mouth 21, of course, is not heat sealed together and contains the zippered closure device to releasably seal the contents stored within the storage volume or cavity of the bag assembly 20.

Similar to conventional sandwich-style poly bags, the zipper closure device 30 is employed so that the mouth 21 can be opened and closed manually in a reusable manner. More preferably, this zipper closure device 30 primarily consists of opposing, rectangular-shaped first and second support sheets 42, 43 each of which house interlocking first and second track members 45, 46, respectively. These first and second support sheets 42, 43 are melded, adhered and/or molded into the upper portions of the respective first and second side panels 23, 25, respectively, thus becoming single units therewith, proximate to the mouth 21. The first track member 45 and the second track member 46 are disposed opposite to, and aligned with, one another such that when the respective track members 45, 46 are fully engaged (FIGS. 1 and 5-8), access to the cavity through the mouth, in the closed position, is not permitted. In contrast, when the opposed track members 45, 46 are completely unengaged, (FIG. 2), access to the cavity via the mouth 21 in the opened position is permitted.

Rather than manually pulling apart, or pushing together, the opposed first and second track members 45, 46 in order to operate the zipper closure device 30, the slider device 31 (FIGS. 1-3) is provided that straddles, and slides longitudinally along, the top edges of the zipper closure device 30 between the first position (FIGS. 1 and 5-8), causing the track members 45, 46 to disengage from one another in the opened condition, and the second position (FIG. 2), causing the track members to engage with one another in the closed condition.

The slider device 31 is preferably composed of a polymer material, and includes a conventional internal divider wedge 47 (FIGS. 5, 12 and 13) configured to force the interengaged track members 45, 46 apart as the wedge is moved longitudinally therealong from the first position toward the second position. Conversely, on the other internal side of the slider device 31, a conventional closer device is provided that forces the opposed track members 45, 46 together and into inter-engagement with one another as the slider device is moved longitudinally along the track members 45, 46 from the opened condition toward the closed condition.

Referring now to FIGS. 10-13, the slider device 31 includes a generally rectangular shaped base member 32 having a first slider wall 48 and an opposite second slider wall 50, both of which extend downwardly from an upper portion thereof, in a straddling manner from the zippered closure device 30 top edges. The first slider wall 48 extends downwardly and adjacent to the first support sheet 42 and/or first side panel 23 as well, depending upon the particular fabrication between the poly bag and the zippered closure device 30. Similarly, the opposite second slider wall 50 also extends downwardly and adjacent to the second support sheet and/or the second side panel 25 of the bag.

In accordance with the present invention, the reusable child resistant bag assembly 20 includes the lock device 36 cooperating between the first and second wings 33, 35 to releasably lock the slider device 31 in the first position. As indicated above, a locked slider device will retain the zippered closure device 30 in the closed condition until selectively released. The lock device 36 is preferably incorporated into, and part of, the wings 33, 35 of the slider device 31. Further, the locking post 37 of the lock device cooperates with the poly bag 22 itself and/or the support sheets 42, 43 of the zipper closure device 30 (FIG. 5), as well as with the aligned locking port 40 to secure the slider device in the first position (FIGS. 1 and 5-8).

As best viewed in FIGS. 8 and 9, the locking post 37 of the lock device 36 can be manually removed from the aligned locking port 40, in the locked state (FIGS. 1, 6 and 7) to the unlocked state (FIGS. 2-5 and 8-13), by someone other than a young child. This disengages the locking post 37 from engagement through the retaining aperture of the poly bag 22 so that the slider device 31 can be moved toward the second position, enabling the closure device 30 to move the bag mouth to the opened condition.

Each of the opposed first and second wings 33, 35 extend distally (generally in the direction of motion as the slider device moves from the second position toward the first position) from a side of the respective first and second slider walls 48, 50 of the slider device 31. These wings 33, 35 are integrally formed with the slider device 31, but are generally thinner than that of the respective slider walls 48, 50 so as to be relatively flexible for movement between the locked and unlocked conditions.

As mentioned, to facilitate locking of the lock device 36, a locking post 37 extends laterally away from the interior surface of the first wing 33 toward the opposed interior surface of the second wing 35. This locking post 37 extends in a direction generally perpendicular to both the first and second wing 33, 35, and is of a longitudinal length sufficient to span through at least the poly bag 22, and engage the second wing 35, in the locked position.

The lock device 36 further includes a mushroom-shaped head portion 51 (FIGS. 12 and 13) at the distal end of the locking post 37 having a diameter and circumference slightly larger than that of the central portion locking post 37. This slight dimensional increase in the circumferential footprint of the head portion enables a conventional snap-fit or press-fit type engagement through the strategically aligned wing locking port 40 extending laterally through the second wing 35.

Similarly, when the slider device 31 is moved fully to one end of the track members 45, 46 (i.e., the first position), placing the track members in the fully interengaged condition (FIGS. 1 and 5-8), the retaining aperture 38 that extends laterally through the first side panel 23 and the second side panel 25 of the poly bag is strategically placed to enable passage of the locking post 37 therethrough (FIG. 5), enabling the locking post 37 to be moved to the locked condition.

To move the head portion 51 through the second wing locking port 40, into the locked condition, the exterior surfaces of the respective first and second wings 33, 35 are manually compressed together (e.g., FIG. 6), forcing the head portion 51 through the wing locking port 40. The slider device 31, hence, is retained in the first position, retaining the closure device in the closed condition (FIG. 7).

To increase the structural integrity around the wing locking port 40, an annular support ring (not shown) may be provided on the interior surface, the exterior surface, or both surfaces of the second wing 35. Radial slits (not shown) may also be incorporated to facilitate flexibility of the wing locking port 40 so that the head portion of the locking post 37 can be more easily positioned therethrough.

Figure 10:
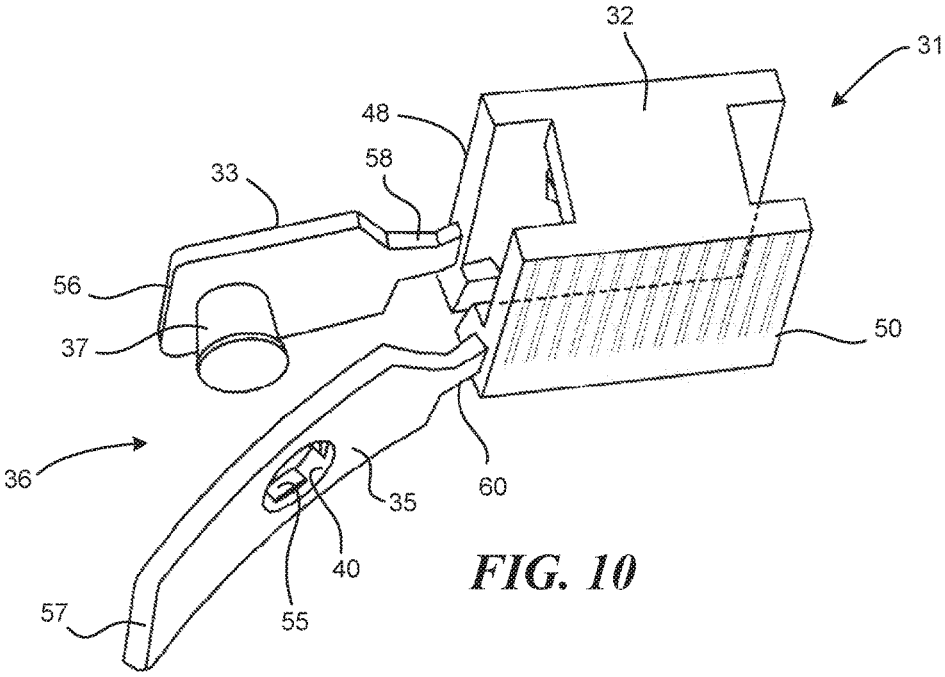
FIG. 10 is an enlarged top perspective view of the slider device of the child resistant plastic bag assembly of FIG. 1.
Figure 11:
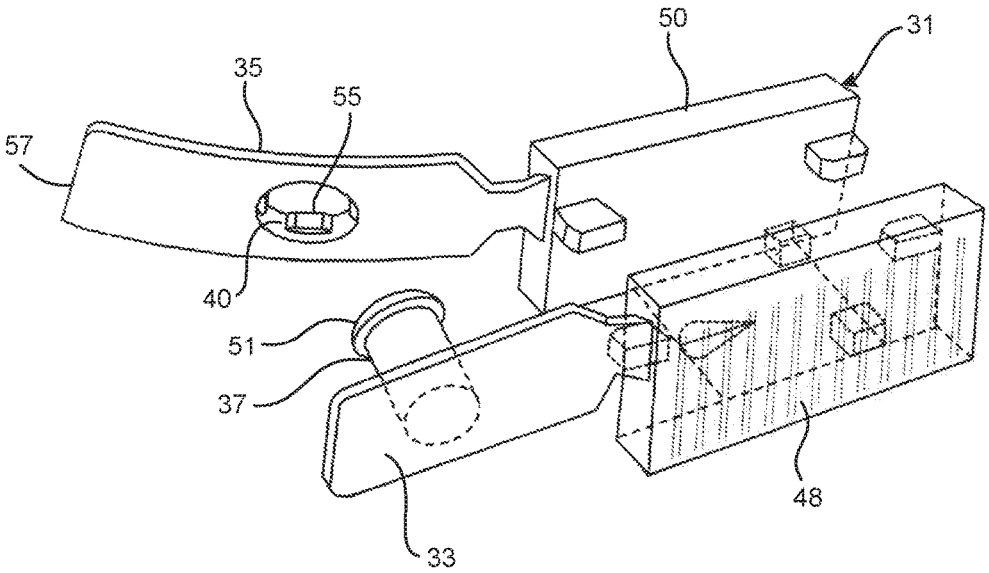
FIG. 11 is a bottom perspective view of the slider device of FIG. 10.
Figure 12:
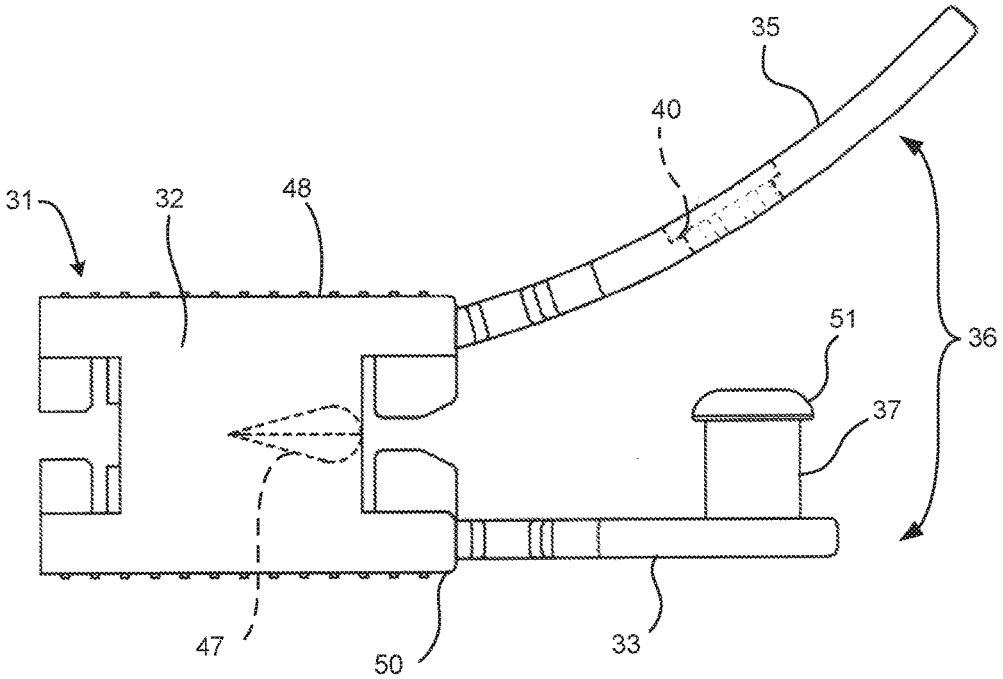
FIG. 12 is a top plan view of the slider device of FIG. 10.
Figure 13:
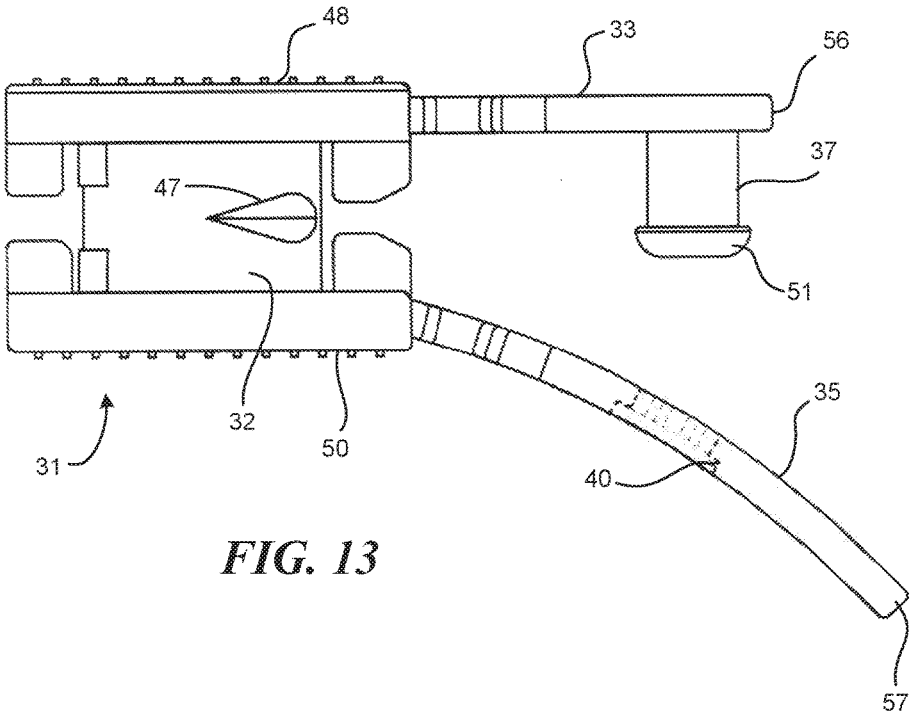
FIG. 13 is a bottom plan view of the slider device of FIG. 10.

Alternatively, as best viewed in FIGS. 10 and 11, the locking port 40 may include one or more retaining tabs 55 that extend radially into the locking port 40. These one or more retaining tabs 55 are integral with the circumferential walls that define the port, and are elastically configured to facilitate retention of the head portion 51 of the locking post 37 therethrough, in the locked state. To remove the locking post therefrom, to the unlocked state, a sufficient amount of force (see FIG. 8, and as will be described in greater detail) is applied axially to the head portion to force the locking post 37 out of the locking port 40.

Accordingly, depending upon the footprint differential between circumference of the head portion 51 and the wing locking port 40, the material thereof, and the overall thickness of the wing, including the annular ring, if necessary, as well as other physical attributes (i.e., slits 53 or retaining tabs 55), the force necessary to position the head portion 51 of the lock device 36 through and out of engagement with the wing locking port 40 can be manipulated. For instance, using these variables, the lock device 36 can be designed so that at least a sufficient force (e.g., 2-10 lbf) is necessary to withdraw the head portion 51 of the lock device 35 through the wing locking port 48 to unlock the lock device 35, or to conform with the required safety standards such as ASTM D3475 (the Standard of Classification of Child Resistant packages), or Title 16 CFR 1700 (the requirements for child resistance stated in the Poison Prevention Packaging Act).

As best viewed in FIGS. 5-13, the first and second wings 33, 35 are sufficiently long, so as to provide respective, distal tabbed end portions 56, 57 that extend distally past the central location of locking post 37 and wing locking port 40, relative to the wings. These tabbed end portions 56, 57 enable the operator to grip and pull the engaged lock device 36 apart, releasing the head portion 51 from locked engagement with the wing locking port 40.

The respective tabbed end portion 57 of the second wings 35 is longer than that of the first wing 33 to promote gripping thereof for increased manipulation of the lock device to both move the locking post to the locked state, as well as remove the post from the locked state to the unlocked state. Although the flexible nature of the first and second wings themselves allow the locking post 37 to be engage into or be withdrawn from the retaining aperture 38, for example, by those six years and older, this off-set configuration of the tabbed end portions 56, 57 facilitates operation of the lock device, effectively allowing a stouter lock device to be incorporated.

Figure 6:
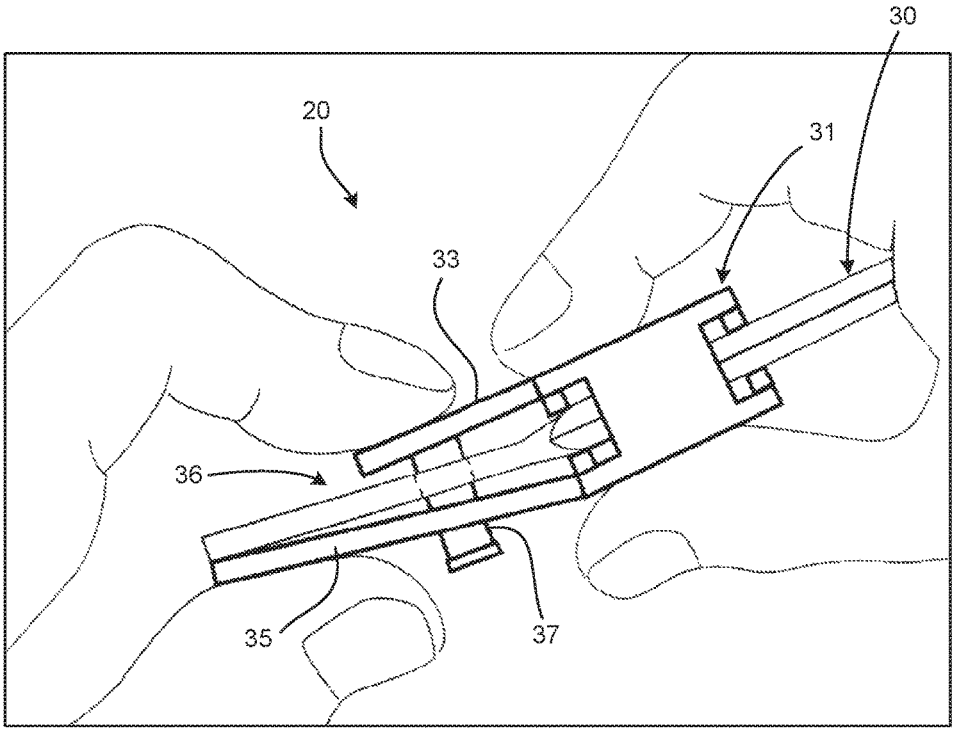
FIG. 6 is a fragmentary, top perspective view of the child resistant plastic bag assembly of FIG. 1, showing the lock device in the locked state.

More preferably, as best illustrated in FIGS. 6-8, the longitudinal length of the second wing 35 is significantly longer than that of the is first wing 33, and is further configured such that when the slider device 31 is in the first position, the distal tabbed end portion 57 of the second wing 35 terminates proximate to the common edge 27 of the first and second side panels 23, 25. By configuring the second wing 35 adjacent to the sheet panels, and such that the second wing distal end terminates adjacent to the sheet panels common edge 27 (while the tabbed end portion 56 of the first wing 33 does not), when slider device is oriented in the first position, both the sheet panels 23, 25 and the second wing 35 can be employed to facilitate both engagement and release of the locking post 37 into and from the locking port 40. That is, as best illustrated in FIG. 8 for instance, a significantly larger area of the side of the first side panel 23 can be utilized to push against the second wing 35 (as compared to only gripping the second wing) to facilitate release mushroom-shaped head portion of the locking post 37 from the tabbed locking port 40. Accordingly, this off-set configuration, as well as the removal technique utilized, significantly simplifies the simultaneous release the locking post 37 from both the locking port 40 and the retaining aperture 38 of the bag assembly 20 while still maintaining sufficient integrity to be child proof.

Figure 14:
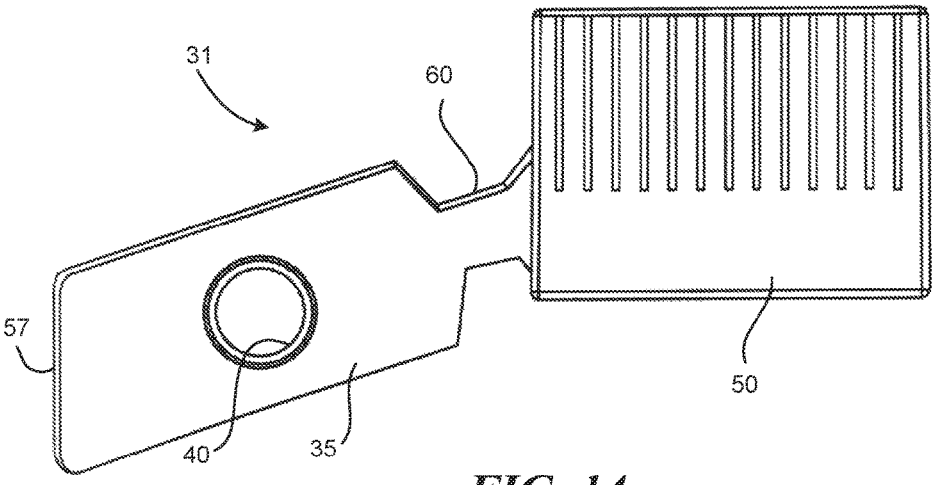
FIG. 14 is a side elevation view of the slider device of FIG. 10.

In one specific embodiment, the first and second wings 33, 35 may be integrally connected to the respective first and second slider walls 48, 50 through respective neck portions 58, 60 (FIGS. 10, 11 and 14). These narrower neck portions 58, 60 enable more flexibility of the respective wings 33, 35 to move between the locked and unlocked positions.

Turning now to FIGS. 1 and 14, first and second wings 33, 35 can be angled slightly downward, positioning the locking post 37 below the base member 32. This is advantageous in that the wings are repositioned out of the general horizontal level of the slider base member 32, facilitating operational gripping of the wings.

To also increase the structural integrity around the retaining aperture 38, so as to retain and maintain the locking post 37 therein, the surrounding area around the retaining aperture, between the first and second side panels 23, 25 of the poly bag 22 and the respective first and second support sheets 42, 43 of the closure device 30 can be heat sealed together using conventional means, strengthening the bond. This may be performed when the ends of the track members 45, 46 are heat sealed together, forming unitary support ends of the adjacent first and second support sheets. Moreover, structural eyelet devices (not shown) may also be incorporated around the retaining aperture 38 to further bulk up this region.

Figure 15:
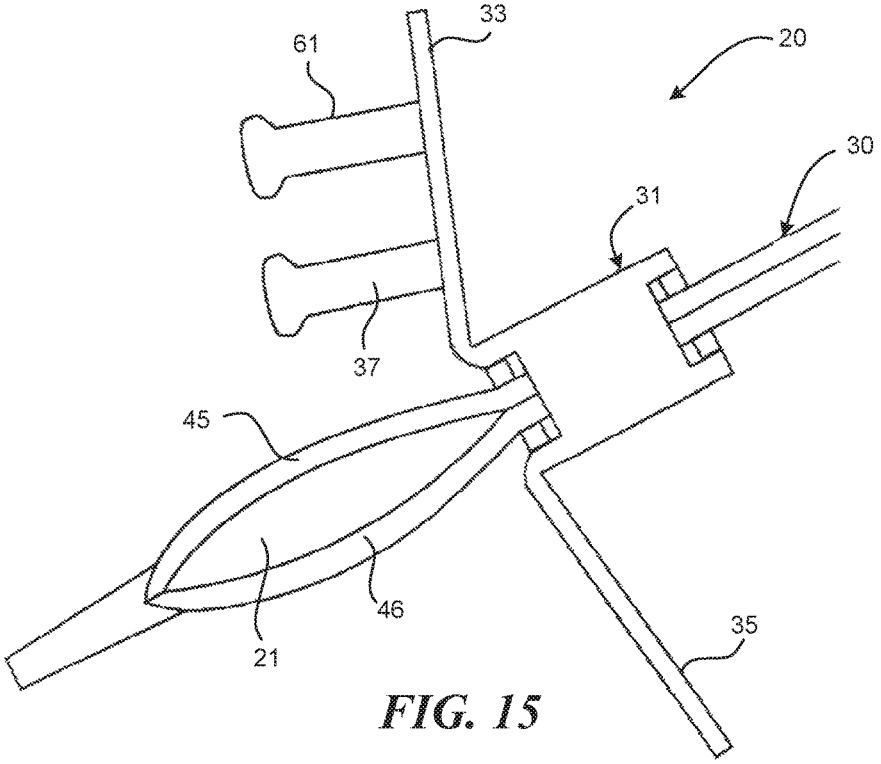
FIG. 15 is a top plan view of an alternative embodiment child resistant plastic bag assembly having two locking posts, shown in an unlocked state.
Figure 16:
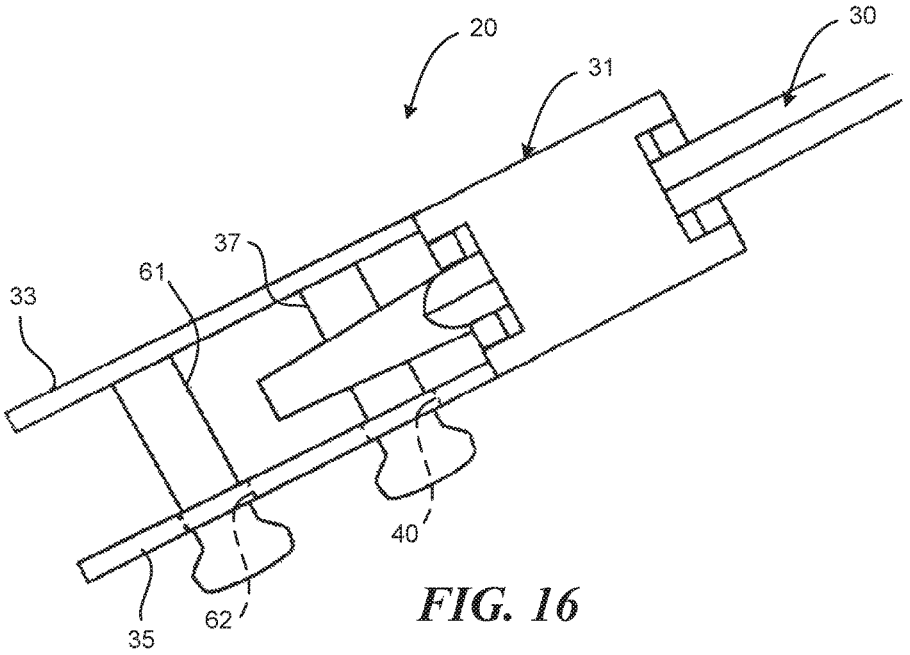
FIG. 16 is a top plan view of the alternative embodiment child resistant plastic bag assembly of FIG. 15 with two locking posts shown in a locked state.

Referring now to FIGS. 15 and 16, an alternative embodiment is provided where the lock device 36 includes a second locking post 61, disposed adjacent the first locking post 37, as well as a corresponding second locking port 62 on the second wing 35. The outermost, second locking post 61 is preferably outside and adjacent to the common edge 27 of the first and second side panels 23, 25.

Hence, when the second locking post 61 of the lock device 36 is in the locked conditions, the post itself will contact this common edge to further facilitate the prevention of sliding movement of the slider device 31 and track member between the closed condition (FIG. 16) and the opened condition (FIG. 15). Such a dual locking post design provides an added layer of redundancy. This is beneficial should one of the locking posts fail or be inadvertently left in the unlocked condition.

In another alternative embodiment, the locking post could be coupled to the poly bag itself (not shown). That is, the locking post could be mounted to, and protrude outwardly from, the second side panel 25. When the slider device 31 is positioned at the end, and the track members are oriented in the closed position, the second wing 35 could lock and engage with the locking post 37.

While the present invention has been described in connection with the preferred form of practicing it and modifications thereto, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

What is claimed is:

1. A child resistant, zippered plastic bag assembly having an openable and recloseable mouth, the bag assembly comprising:

a sheet-like first side panel and a sheet-like second side panel each having respective upper portions forming the mouth, and an opposing bottom sides, and first and second opposing sides being joined together so as to define a storage volume;

a zippered closure device coupled to the respective upper portions of said first and second side panels for interlocking said mouth between a closed condition and an opened condition;

a slider device having a base member operably mounted to, and cooperating, with the zippered closure device for movement therealong between a first position, orienting said mouth in said closed condition, and a second position, orienting said mouth in said opened condition, said slider device including a first wing extending outwardly from, and fixedly mounted to, said base member, adjacent the respective upper portion of said first side panel, and a second wing also extending outwardly from, and fixedly mounted to, said base member, adjacent the respective upper portion of said second side panel; and a lock device manually operable between said first wing and second wing, and configured to cooperate with said first side panel and said second side panel in a locked state to prevent movement of said slider device toward said second position, releasably locking said slider device in said first position, said lock device includes a locking post extending away from an interior surface of said first wing, toward said second wing, said locking post being configured to be manually positioned through aligned retaining apertures extending through said first and second side panels, when said slider device is oriented in said first position, and into engagement with an aligned locking port in said second wing, reorienting the first and second wings from an unlocked state to a locked state to lock said slider device in said first position, said first and second wings are angled slightly downwardly such that said locking post and said aligned retaining apertures are oriented below said zippered closure device.

2. The zippered plastic bag assembly according to claim 1, wherein said first and second wings extend distally from said base member in a direction away from said second position of said slider device.

3. The zippered plastic bag assembly according to claim 1, wherein said first and second wings are flexibly mounted to said base member at respective neck portions that are narrower than a vertical width thereof.

4. The zippered plastic bag assembly according to claim 1, wherein said locking post and said locking port are configured to removably lock to one another in said locked state.

5. The zippered plastic bag assembly according to claim 4, wherein said locking post includes a head portion at a distal end thereof the locking post having a diameter and circumference slightly larger than that of the locking post, and configured for press-fit through said locking port.

6. The zippered plastic bag assembly according to claim 5, wherein said locking port includes one or more retaining tabs.

7. The zippered plastic bag assembly according to claim 1, wherein said second wing is longer than that of said first wing along respective longitudinal axis thereof.

8. The zippered plastic bag assembly according to claim 7, wherein a longitudinal length of said second wing is such that when in said locked state, a distal end of said second wing terminate proximate to the first side of said first and second side panels.

9. The zippered plastic bag assembly according to claim 1, wherein said align retaining apertures are disposed in reinforced respective upper portions of said zippered closure device.

* * * * *